United States Patent [19]

Younker

[11] 4,023,220

[45] May 17, 1977

[54] INFLATABLE BATHING TUB

[76] Inventor: Susan Myers Younker, 3033 Deakin St., No. 3, Berkeley, Calif. 94705

[22] Filed: July 23, 1975

[21] Appl. No.: 598,546

[52] U.S. Cl. ..... 4/177 CW; 4/145

[51] Int. Cl.[2] ..... A47K 3/06

[58] Field of Search ..... 4/173, 177 CW, 172, 4/185 B, 185 AB, 145

[56] References Cited

UNITED STATES PATENTS

| | | | |
|---|---|---|---|
| 755,747 | 3/1904 | Coile | 4/177 |
| 2,838,768 | 6/1958 | Fischett | 4/177 |
| 2,950,484 | 8/1960 | Jaffe | 4/177 |
| 2,995,760 | 8/1961 | O'Brien | 4/177 |
| 3,606,617 | 6/1969 | Frazier | 4/145 |
| 3,931,652 | 1/1976 | Navarra | 4/177 CW |

*Primary Examiner*—Robert I. Smith

[57] ABSTRACT

An inflatable bathing tub has a size whereby it may be conveniently placed into a shower stall. The tub is fabricated of an attached and ascending series of interconnected inflatable annular tubes, preferably of increasing diameters. Drainage means allow the tub to be conveniently drained into the shower stall drain, or other location, as desired. The tub is provided with a base which has bottom feet to raise the tub slightly so that when said tub is used in conjunction with a shower stall, the drain of the shower stall remains substantially unblocked. The tub has an overflow outlet which may be positioned toward the rear of the shower stall so as to preclude splashing of water outside the stall.

6 Claims, 3 Drawing Figures

INFLATABLE BATHING TUB

BACKGROUND OF THE INVENTION

1. Field of Invention

The subject invention relates to bathtubs, and specifically to an inflatable bathtub for use primarily, but not exclusively, within a shower stall.

2. Description of Prior Art

Many persons lack a bathtub in their apartment or home but have at their disposal a shower stall. Although such persons may prefer to take baths rather than showers, there is presently no way for them to do so conveniently. It would be desirable if such persons could be provided with means which could effectively contain enough water within the confines of the shower stall to bathe comfortably therein, and thus take advantage of the space and plumbing facilities within the shower stall.

Even if available, conventional bathing tubs, which do allow bathing in a relatively reclined position, are often not considered particularly comfortable due to the hard and unyielding material from which they are constructed. Also their typical design affords a somewhat unnatural and uncomfortable position for some people. Present adult bathtubs are generally stationary, expensive to purchase and install, and very space consuming, causing many people to do without them who might otherwise enjoy the opportunity of bathing or soaking in a tub of water.

OBJECTS OF THE INVENTION

Overcoming the above-mentioned difficulties, the present invention is designed to provide a bathing tub which may be positioned and inflated within a shower stall, allowing an adult, sitting therein, to immerse his or her body in water; a tub as described which embodies a simple and efficient drainage means allowing access, when desired, to the drain of a shower stall; a bathing tub which can be deflated and easily transported or stored in a compact manner; a bathing tub which may be used in diverse locations such as cabins without plumbing, campers and trailers and the like; a tub which cushions the body of its user; a convenient means for therapeutic bathing with health salts, herbal substances, or the like; a bathing means which may require less water than conventional bath and shower methods, due to the fact that the bather's body may fill a large portion of the tub, thereby requiring less water to fill the remaining portion thereof; and a tub as described which is relatively inexpensive to manufacture.

These and other objects and advantages of the invention will become apparent during the course of the following description.

DETAILED DESCRIPTION OF A PREFERRED EMBODIMENT

Figure 1:
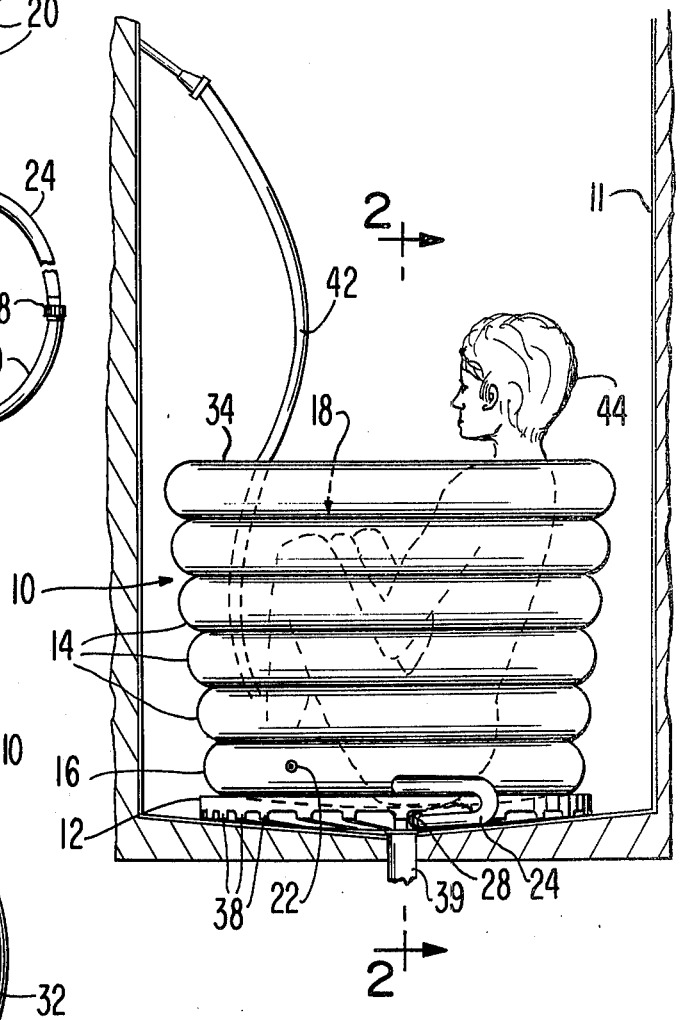
FIG. 1 is a front elevational view of the tub of the invention positioned within a shower stall and shown in use by a bather.

Referring now to the drawings, FIG. 1 shows a circular tub 10 positioned in a shower stall 11. Tub 10 is comprised of a base or bottom member 12 and a plurality of inflatable air- and watertight annular rubber, plastic or fabric-covered rubber tubes 14 which are vertically stacked and interconnected, the lowermost tube 16 being attached to base 12 throughout the entirety of its circumferential bottom surface. Each upwardly succeeding tube is of slightly larger diameter than the tube preceding it, creating, in effect, a circular wall 18 which angles slightly outward from base 12.

Figure 2:
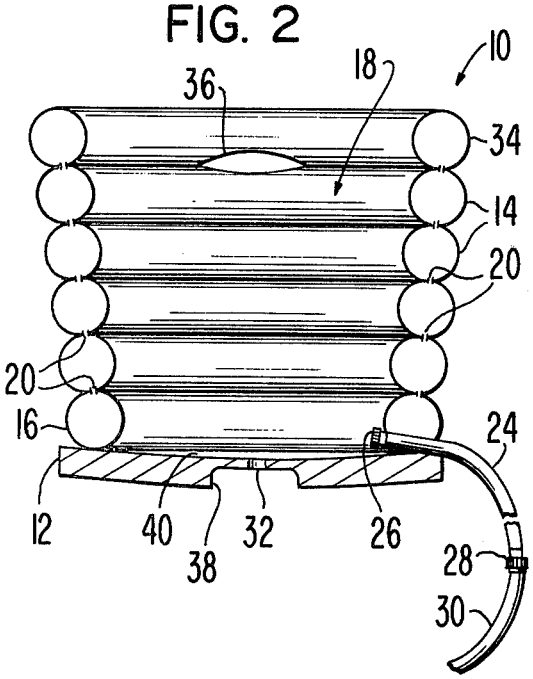
FIG. 2 is a sectional view of the tub taken along line 2—2 of FIG. 1.

The attachment of tubes 14 one to another is preferably done by a heat process or can be done by an adhesive such that a circumferential portion of the upper surface of one tube is attached to a corresponding portion of the lower surface of the tube above it, as illustrated in FIG. 2. The joined surfaces of each pair of tubes contains one or more holes 20 which allow air to flow between the lumens of all of the tubes for the purpose of inflation and deflation.

On the outer surface of lowermost tube 16 is an air-valve 22 leading into the interior of said tube, which is used to inflate and deflate tub 10. Valve 22 is preferably of the automobile or bicycle tire type so that a conventional air pump inflation hose can be attached thereto. Alternately valve 22 can be of the type which can be filled by mouth. The portion of the tub where the valve is situated will hereinafter be referred to as the front of tub 10.

Also in the front portion of tub 10 is a flexible drainage hose 24 which extends from the interior of the tub to the exterior of same, and also extends outwardly from such exterior a short distance. The interior end of said drainage hose contains a removable drain plug 26 whereby the tub can be drained when desired by removal of said plug. The exterior end of said drainage hose contains coupling means 28 whereby an extension hose 30 may be attached thereto for the purpose of draining the tub to a location remote from the tub, as might be desired if said tub is being used in a cabin or tent or the like, which does not have plumbing facilities. Additionally or alternatively a capped drain plug 32 in the center of base 12 may be provided.

In the rear portion of the tub, located within and between the uppermost tube 34 and the next lower tube is an overflow aperture 36 (FIG. 2) which may be formed by appropriate shaping of the adjacent portion of uppermost tube 34 and the next lower tube and not joining these portions together. Aperture 36 allows any excess water to flow into the rear of the shower, thus avoiding spillage toward the front of the shower stall where the water would be likely to spill outside the stall.

Figure 3:
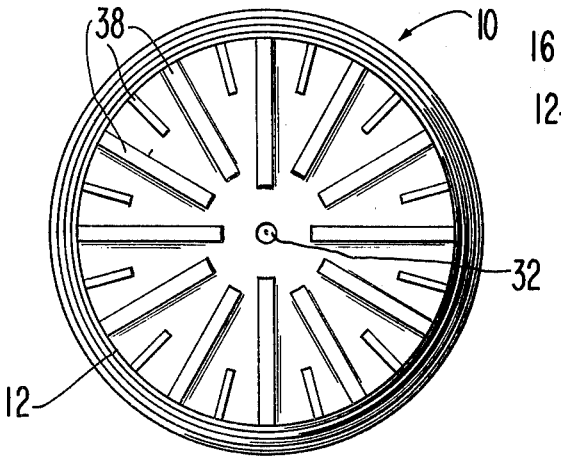
FIG. 3 is a bottom view of the base of the tub.

Base or bottom member 12 is preferably circular in shape and constructed of a hard rubber, plastic, or similar material which is flexible enough to allow sufficient bending that it may conform to a somewhat concave shower stall floor, as illustrated in FIG. 1, yet firm enough to hold the weight of the tub when filled with both water and a bather. As best illustrated in FIG. 3, base 12 has integral projecting ridges 38 to allow water to flow thereunder, and into the drain of a shower stall 11, when desired. Ridges 38 are spaced in such manner that the free end of drainage hose 24 may be wedged between same, thus directing the drainage water in the direction of shower stall drain 39. The upper surface of base 12 is preferably covered by a padded floor surface 40 comprising a layer of foam-rubber or the like covered by a watertight covering such as a vinyl sheet.

For use in an average size shower stall tub 10 may be about 27 inches (69 cm) high, the uppermost tube 34 about 34 inches (86 cm) in diameter across, so as to just contact the walls of the stall, and lowermost tube 16 about 30 inches (76 cm) in diameter across. Holes 20 may be about 0.5 inch (1 cm) in diameter and overflow aperture 36 may be about 5 inches (13 cm) long and 1.5 inches (4 cm) high. Ridges 38 may be about 1 inch (3 cm) high. In a collapsed (deflated) state the tub would thus be about 30 inches (76 cm) in diameter and 5 inches (13 cm) high. In a large shower stall, wall 18 of the tub need not contact the side walls of said stall, the unit being self-supporting, yet in an undersize stall the tub is flexible enough to be bent inwardly so as to fit within the walls of the stall, thereby partially conforming to the shape of the stall, thus more fully utilizing the space within said undersize stall.

OPERATION OF INVENTION

In operation, tub 10 is a collapsed state is placed in shower stall 11 and inflated by pumping or blowing air through valve 22. The tub is oriented so that drain hose 24 is near the shower stall opening, and overflow aperture 36 faces the rear of the shower stall. The free end of hose 24 is then wedged under the base between ridges 38. Tub 10 is partially filled with water, either by adjusting the shower head to a non-spray condition and directing the stream to the interior of the tub or by removing the shower head an attaching a length of hose to the shower head pipe and placing the free end of that hose into the tub as illustrated in FIG. 1. Note that the tub need be only partially filled because the body of the bather 44 (FIG. 1) will displace much of the space within the tub and thus raise the water level considerably.

The bather may turn the water off and enter the tub, sitting and/or standing therein for bathing and/or soaking purposes. He may also leave the water running if he prefers a continuous flow of fresh water through the tub as he bathes. The water overflows through aperture 36 onto the floor of the rear portion of the stall, running through ridges 38 and into the shower stall drain 39, thus avoiding spillage outside the confines of the shower stall.

An alternative means of operation would be to inflate tub 10 in a location independent of a shower stall, fill the tub with water from whatever source available, attach the extension of the drainage hose 30 to the regular drainage hose 24 if desired to drain into a location remote from the tub, place the exterior end of said hose in the desired location for drainage, enter the tub, and bathe.

In either form of operation, when the bather is finished bathing or soaking, he removes the removable drain hose plug 26 or the cap of drain plug 32 to allow the water to drain out of the tub 10 through the drainage hose 24 or plug 32 and into the desired drainage location. The tub may then either be left in place or deflated and stored.

It is to be understood that the form of my invention, herewith shown and described, is to be taken as a preferred example of the same, and that various changes in type of construction, shape, size, general design and the like may be resorted to without departing from the spirit of my invention, or the scope of the claims and their equivalents. For example the tub can have straight rather than sloping sides; base support 12 can be separate from the rest of the tub instead of joined thereto, the walls of the tub can be formed of a single spiraling tube, the tube or tubes may be covered with a smooth sheet, and the overflow aperture may be omitted or provided with a plug device to achieve a higher water level if desired.

What is claimed is:

1. An inflatable bathing tub comprising a base, an enclosing side wall portion connected to and extending upwardly from said base to define a water-tight bathing tub, said side wall portion being formed of an airtight, flexible material and comprising an airtight chamber spaced such that said side wall portion will be self-supporting when said chamber is inflated, air valve means in said side wall portion for enabling said chamber to be inflated and deflated, valve means in said bottom portion for enabling said tub to be drained of water, said base of said tub having a ridged bottom surface to hold said tub at an elevated level, above a supporting surface, thereby allowing water to drain thereunder into the drain of a shower stall, said tub being approximately 2½ to 3 feet in diameter and about 2 to 3 feet high so as to be large enough to be placed within a single-person shower stall, whereby a person may place said tub within a shower stall and employ said tub as a water-containing means for the purpose of bathing in an upright sitting position.

2. The bathing tub of claim 1 wherein said bottom member comprises a padded floor surface facing the interior of said tub, whereby the body of the user of said tub is comfortably cushioned while bathing.

3. The bathing tub of claim 1 comprising primary drainage means positioned near the bottom of said side wall portion, said primary drainage means comprising a flexible drainage hose interconnecting the interior and exterior surfaces of said tub and extending outwardly therefrom, and removable plug means fitting into the interior end of said drainage hose, whereby water may either be contained within said tub or allowed to drain therefrom; and secondary drainage means consisting of an overflow aperture near the top of said side wall portion whereby said tub may be positioned in a shower stall with said aperture facing the rear portion of said stall, whereby overflow water will be shunted through said aperture so as to preclude spillage outside the confines of said shower stall.

4. The bathing tub of claim 3 wherein the external end of said drainage hose contains coupling means allowing an extension hose to be added thereto, whereby said tub, when used independently of said shower stall, may be drained at a distance from its location.

5. The bathing tub of claim 4 wherein said ridges in said bottom surface are shaped and positioned such that a drain hose connected to said valve means may be securely wedged between said ridges thereby allowing drainage water from said hose to be shunted in the direction of said shower stall drain.

6. The bathing tub of claim 1 wherein said base containing said ridged bottom surface includes means for removably attaching said base to remaining portion of said tub.

* * * * *